US007566057B2

(12) United States Patent
Mascolo

(10) Patent No.: US 7,566,057 B2
(45) Date of Patent: Jul. 28, 2009

(54) STACKING PUZZLE AND METHOD FOR PLAYING SAME

(76) Inventor: Victor Mascolo, 42 First Ave., Bayville, NY (US) 11709

( * ) Notice: Subject to any disclaimer, the term of this patent is extended or adjusted under 35 U.S.C. 154(b) by 283 days.

(21) Appl. No.: 11/701,454

(22) Filed: Feb. 1, 2007

(65) Prior Publication Data

US 2008/0185781 A1 Aug. 7, 2008

(51) Int. Cl.
*A63F 9/08* (2006.01)

(52) U.S. Cl. ..... 273/153 P; 273/153 S; 273/153 J

(58) Field of Classification Search ..... 273/153 S, 273/156, 153 J, 290, 153 P
See application file for complete search history.

(56) References Cited

U.S. PATENT DOCUMENTS

| | | | | |
|---|---|---|---|---|
| 303,946 | A | 8/1884 | Ohlert | |
| 983,730 | A * | 2/1911 | Leach | 273/153 S |
| 1,419,871 | A * | 6/1922 | McDonald | 235/123 |
| D135,848 | S | 6/1943 | Drueke | |
| 2,595,938 | A | 5/1952 | Grant | |
| 2,738,979 | A | 3/1956 | Dalton | |
| 3,556,526 | A | 1/1971 | Currie | |
| 3,561,774 | A * | 2/1971 | Brinser | 273/241 |
| D225,543 | S | 12/1972 | Hardesty | |
| 4,043,561 | A | 8/1977 | Stepansky | |
| 4,119,320 | A | 10/1978 | Chorba et al. | |
| 4,485,585 | A | 12/1984 | Shackelford et al. | |
| D359,083 | S | 6/1995 | Engelbrecht et al. | |
| 5,560,605 | A | 10/1996 | Garcia | |
| 5,992,851 | A | 11/1999 | Ajtai | |
| 6,224,453 | B1 | 5/2001 | McKinley, Jr. et al. | |
| 6,352,262 | B1 * | 3/2002 | Looney | 273/290 |

FOREIGN PATENT DOCUMENTS

GB 2236955 A * 4/1991

OTHER PUBLICATIONS

International Search Report for International Application No. PCT /US 08/00829 dated Jun. 24, 2008 (enclosed).
Written Opinion of International Searching Authority for International Application No. PCT /US 08/00829 dated Jun. 24, 2008 (enclosed).

* cited by examiner

*Primary Examiner*—Steven Wong
(74) *Attorney, Agent, or Firm*—Collard & Roe, P.C.

(57) ABSTRACT

A stacking puzzle has a substantially horizontal stationary base, a plurality of stacks of playing pieces of progressively larger diameters having bores therethrough and a plurality of upwardly extending pegs. The pegs include shared pegs for receiving playing pieces from two of the stacks and unshared pegs for receiving playing pieces from only one of the stacks. An object of the puzzle is to displace each of the stacks in the fewest number of moves by moving the playing pieces one at a time from peg to peg. A playing piece cannot be placed over a playing piece of the same or smaller diameter and a playing piece from a stack not associated with a particular unshared peg cannot be placed on that unshared peg.

17 Claims, 9 Drawing Sheets

STACKING PUZZLE AND METHOD FOR PLAYING SAME

BACKGROUND OF THE INVENTION

1. Field of the Invention

The invention relates to stacking puzzles and methods for playing stacking puzzles. More particularly, the invention relates to stacking puzzles and methods of playing same wherein an object of the puzzle is to displace a plurality of stacks of playing pieces from an initial position to a final position in a minimum number of moves.

2. The Prior Art

Various stacking puzzles or games based on the traditional "Towers of Hanoi" and "Reve's Puzzle" methods are known.

Known Towers of Hanoi puzzles typically include three pegs extending upwardly from a base and a single group or stack of playing pieces or disks (usually seven or eight) of incrementally increasing diameter. Each disk may have a central opening for sliding it onto a peg. Initially, all of the disks are stacked on a single peg, arranged by size, so that the largest disk is at the bottom of the stack and the smallest disk is on top. The object of the puzzle is to move all of the disks from the first peg to the third peg in the least number of moves, while observing the following two rules: 1) only one disk may be moved at a time (i.e. the topmost disk is taken from a stack and placed on another peg, either starting a new stack or on top of the disk or disks on a second stack); and 2) no disk may be placed on top of a smaller disk.

Reve's puzzle is a variation on the above-described Towers of Hanoi puzzle, wherein four pegs instead of three are provided. The additional peg in the Reve's puzzle decreases the minimum number of moves in the Reve's version, but complicates achieving the minimal solutions. A fifteen disk Reve's puzzle with four pegs would take a minimum of 131 moves to solve and a fifteen disk Towers of Hanoi type puzzle with three pegs would take a minimum of 32,767 moves to solve. The seven disk Towers of Hanoi puzzle takes a minimum of 127 moves to solve and these are easier to execute than the 131 moves of the fifteen disk Reve's puzzle.

The following references, the disclosures of which are incorporated herein by reference, relate to various stacking puzzles or games and puzzles based on the traditional Towers of Hanoi method.

U.S. Pat. No. 4,119,320 to Chorba et al. shows a three-dimensional game including a flat base having a plurality of upwardly extending elongated pegs for receiving playing pieces. The playing pieces each have a central opening for sliding the individual piece over the peg and may include a group of black pieces and a group of white pieces.

U.S. Pat. No. 4,043,561 to Stepansky shows a Towers of Hanoi-type puzzle with a base, five upwardly extending pegs and a single set of graduated size markers. Each of the markers has a number indicated thereon and three of the pegs correspond to a subset of the numbered markers.

U.S. Pat. No. 5,560,605 to Garcia et al. shows Towers of Hanoi and Reve's puzzle games which incorporate an electrical circuit for illuminating a light to indicate that the puzzle has been completed. The games include a single stack of disks wherein the disks may be sequentially numbered or provided in different colors.

U.S. Pat. No. 5,992,851 to Ajtai shows a mechanical puzzle based on the Towers of Hanoi game, wherein the traditional game rules are automatically implemented as a result of the mechanical structure of the game. The game may include two sets of disks with different color schemes.

U.S. Pat. No. 3,556,526 to Currie shows a three dimensional game apparatus including a game board with a plurality of upwardly extending pegs and two sets of magnetic disk-shaped playing pieces. The object of the game is to arrange three playing pieces from a particular set in a row, either horizontally, diagonally or vertically up an individual peg.

U.S. Pat. No. 2,738,979 to Dalton shows a disk transfer game having a triangular base with four upwardly extending pegs and a single stack of disks. The disks are adapted to nest into one another and the base includes cavities for storage of the disks and pegs.

U.S. Pat. No. 983,730 to Leach shows a puzzle including a base, five upwardly extending pegs and four conical stacks of disks. The object of the puzzle is to invert each stack on the peg where the stack originally stood, by moving a single disk at a time.

U.S. Pat. No. 2,595,938 to Grant shows a Towers of Hanoi-type puzzle having rectangular pieces which form a truncated pyramid shape when stacked.

U.S. Pat. No. 4,485,585 to Shackelford et al. shows a toy stacking game for pre-school children including rings of various colors stacked on upwardly extending posts.

U.S. Design Pat. No. D359,083 to Engelbrecht et al. shows an ornamental design for a Towers of Hanoi-type game having square-shaped disks and truncated pyramid-shaped posts.

U.S. Design Pat. No. D225,543 to Hardesty shows an ornamental design for a Towers of Hanoi-type game having triangular disks and pegs and a base having triangular projections.

U.S. Design Pat. No. D135,848 to Drueke shows an ornamental design for a Towers of Hanoi-type puzzle with rectangular disks.

U.S. Pat. No. 303,946 to Ohlert shows a Towers of Hanoi toy.

Although a number of stacking puzzles are known, a need exists for a novel stacking puzzle based on the traditional Towers of Hanoi method. In particular, a puzzle and a method of playing a puzzle according to embodiments of the invention provide for greater player interest and increased complexity by incorporating multiple stacks of playing pieces and additional restrictions on placement of playing pieces over one another and on particular pegs.

SUMMARY OF THE INVENTION

A stacking puzzle and a method for playing a stacking puzzle are provided. A stacking puzzle according to an embodiment of the invention includes a substantially horizontal stationary base. A plurality of stacks of playing pieces are provided, wherein each stack includes a plurality of playing pieces.

Each of the playing piece belonging to a particular stack has a different diameter and a substantially centered bore therethrough. The playing pieces in each stack are initially arranged with a largest diameter playing piece disposed at a bottom position, a smallest diameter playing piece disposed at a top position and the remaining playing pieces arranged in ascending diameter order from said top position to said bottom position.

A plurality of pegs extend upwardly from the base. Twice as many pegs as stacks of playing pieces may be provided. The pegs include a plurality of shared pegs for receiving playing pieces from two of the stacks and a plurality of unshared pegs for receiving playing pieces from only one of the plurality of stacks associated with a particular unshared peg. Each stack of playing pieces is initially disposed over a respective one of the shared pegs. The number of shared pegs may equal the number of unshared pegs and the number of stacks.

An object of the puzzle is to displace each of the plurality of stacks from an initial position on its shared peg to a final position on another peg in a minimum number of moves by moving each of the plurality of playing pieces from its initial position on a shared peg to another peg one at a time. A playing piece cannot be placed over another playing piece having a same or smaller diameter. A playing piece from a stack not associated with a particular unshared peg cannot be placed on that particular unshared peg.

A method for playing a stacking puzzle according to an embodiment of the invention includes the steps of providing a plurality of stacks of playing pieces, each stack including a plurality of playing pieces wherein each playing piece belonging to a particular stack has a different diameter.

A plurality of pegs are also provided. The number of pegs is equal to twice the number of stacks. The pegs include a plurality of shared pegs for receiving playing pieces from two of the stacks and a plurality of unshared pegs for receiving playing pieces from only one stack of the plurality of stacks associated with a particular unshared peg. The number of shared pegs may equal the number of unshared pegs and the number of stacks.

Each stack is initially arranged on a respective one of the plurality of shared pegs with a largest diameter playing piece disposed at a bottom position, a smallest diameter playing piece disposed at a top position and remaining playing pieces arranged in ascending diameter order from top to bottom.

Each of the plurality of stacks is displaced from an initial position on the respective one of the plurality of shared pegs to a final position on another of the plurality of pegs by moving each of the plurality of playing pieces one at a time from its initial position on a shared peg to another of the pegs. A playing piece cannot be placed over another playing piece having a same or smaller diameter. A playing piece from a stack not associated with a particular unshared peg cannot be placed on that particular unshared peg.

An object of the puzzle is to displace each of said plurality of stacks in a minimum number of moves.

A stacking puzzle according to another embodiment of the invention includes a substantially horizontal stationary base. A plurality of stacks of playing pieces are provided, wherein each stack includes a plurality of playing pieces.

Each of the playing pieces belonging to a particular stack has a different diameter and a substantially centered bore therethrough. The playing pieces in each stack are initially arranged with a largest diameter playing piece disposed at a bottom position, a smallest diameter playing piece disposed at a top position and remaining playing pieces arranged in ascending diameter order from said top position to said bottom position.

A plurality of pegs extend upwardly from the base. The pegs include a plurality of shared pegs, which include a plurality of first shared pegs for receiving playing pieces from two of the plurality of stacks and a centrally located universal shared peg for receiving playing pieces from each of the stacks. The number of first shared pegs is equal to the number of stacks and each stack is initially disposed over a respective one of the plurality of first shared pegs. No playing pieces are disposed on the universal shared peg at either a beginning or a conclusion of the puzzle.

The plurality of pegs further include a plurality of unshared pegs for receiving playing pieces from only one of the plurality of stacks associated with a particular unshared peg.

An object of the puzzle is to displace each of the plurality of stacks from an initial position on its shared peg to a final position on another of the pegs in a minimum number of moves by moving each of the plurality of playing pieces from said its initial position on a shared peg to another peg one at a time. A playing piece cannot be placed over another playing piece having a same or smaller diameter. A playing piece from a stack not associated with a particular unshared peg cannot be placed on that particular unshared peg.

A method for playing a stacking puzzle according to another embodiment of the invention included the steps of providing a plurality of stacks of playing pieces, each stack including a plurality of playing pieces, wherein each playing piece belonging to a particular stack has a different diameter.

A plurality of pegs are also provided. The pegs include a plurality of unshared pegs for receiving playing pieces from only one stack of said plurality of stacks associated with a particular unshared peg and a plurality of shared pegs. The shared pegs include a plurality of first shared pegs for receiving playing pieces from two stacks of the plurality of stacks and a centrally located universal shared peg for receiving playing pieces from each of the plurality of stacks.

Each stack is initially arranged on a respective one of the first shared pegs with a largest diameter playing piece disposed at a bottom position, a smallest diameter playing piece disposed at a top position and remaining playing pieces arranged in ascending diameter order from top bottom.

Each of the plurality of stacks is disposed from an initial position on the respective first shared peg to a final position on another of the pegs by moving each of the playing pieces one at a time from the first shared peg to another peg. A playing piece cannot be placed over another playing piece having a same or smaller diameter. A playing piece from a stack not associated with a particular unshared peg cannot be placed on that particular unshared peg.

An object of the puzzle is to displace each of the plurality of stacks in a minimum number of moves.

A method for playing a puzzle according to an embodiment of the invention may be carried out using an actual game board and playing pieces or using a computer simulation of same.

A puzzle and a method of playing a puzzle according to embodiments of the invention provide the advantages of greater player interest and increased complexity by incorporating multiple stacks of playing pieces and additional restrictions on placement of playing pieces over one another and on particular pegs.

In particular, embodiments of the invention supplement a traditional Tower of Hanoi type game by using multiple stacks of playing pieces and supplementing the rules with a rule prohibiting the stacking of two like-size playing pieces over one another. Moreover, embodiments of the invention provide for the use of unshared pegs, wherein only playing pieces from a particular stack may be placed over an associated unshared peg. In further embodiments of the invention, playing pieces and unshared pegs are adapted so that only playing pieces of an associated stack can be placed over the corresponding unshared peg. These and other features contribute to increased challenge and interest in stacking puzzles and methods of playing stacking puzzles according to embodiments of the invention.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
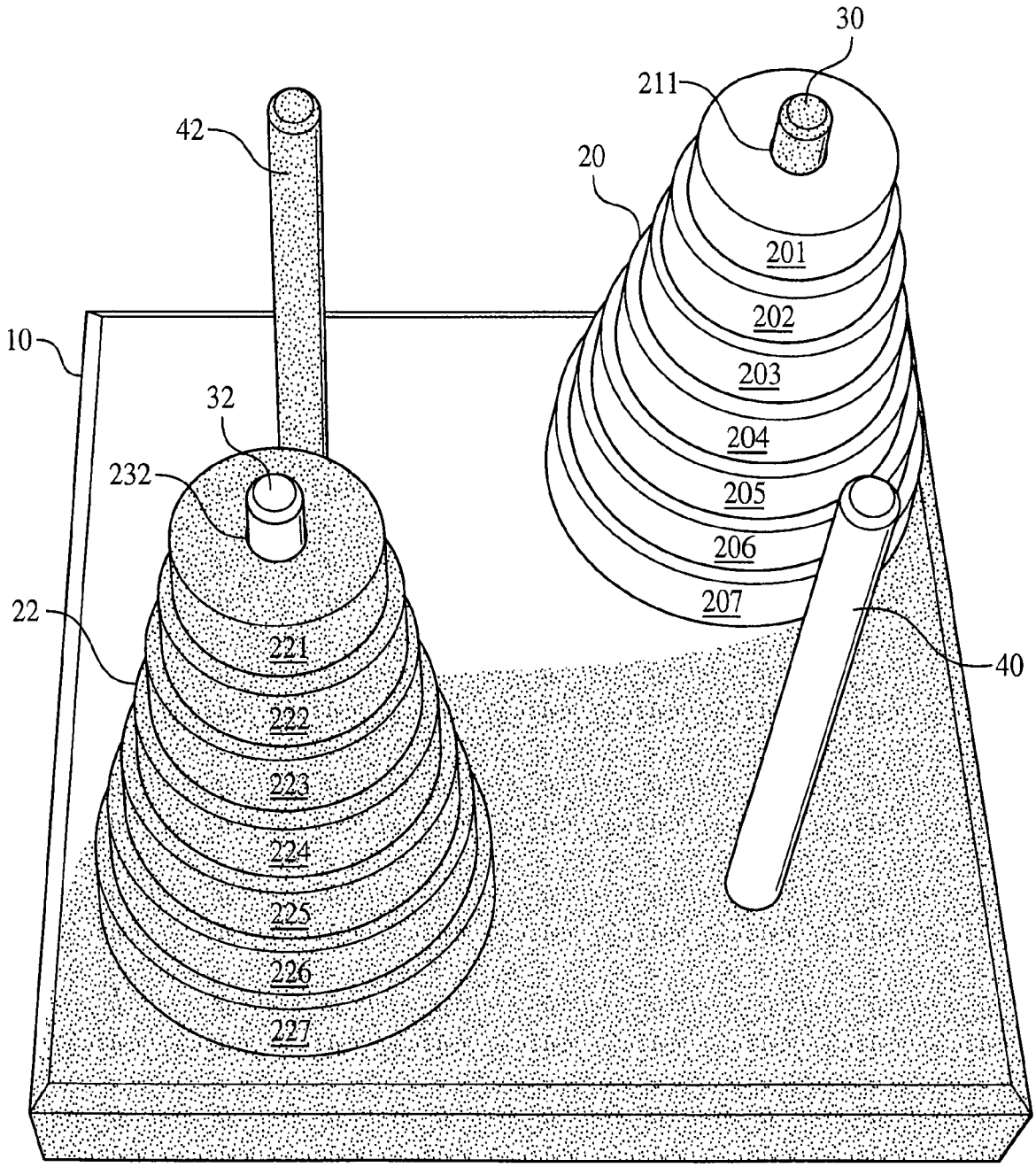
FIG. 1 shows a top perspective view of a stacking puzzle according to an embodiment of the invention.
Figure 2:
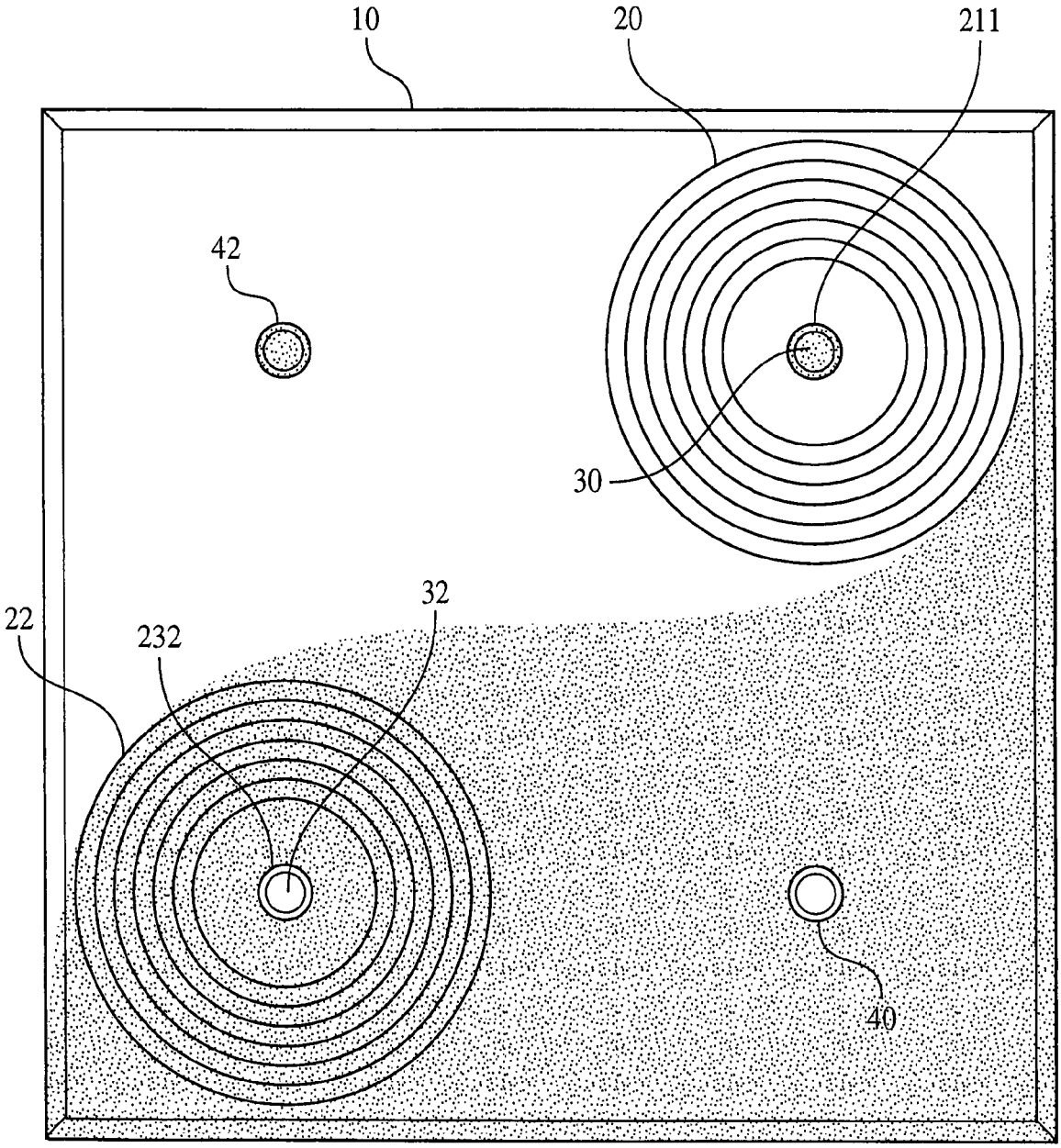
FIG. 2 shows a top view of the stacking puzzle shown in FIG. 1.

Referring now in detail to the drawings and, in particular, FIGS. 1 and 2 show a stacking puzzle according to an embodiment of the invention. An object of the stacking puzzle is to displace each of the stacks of playing pieces from an initial position on a first peg, as shown in FIG. 1, to a final position on a second peg by following the conventional rules for a Tower of Hanoi puzzle as modified and supplemented herein.

Figure 5:
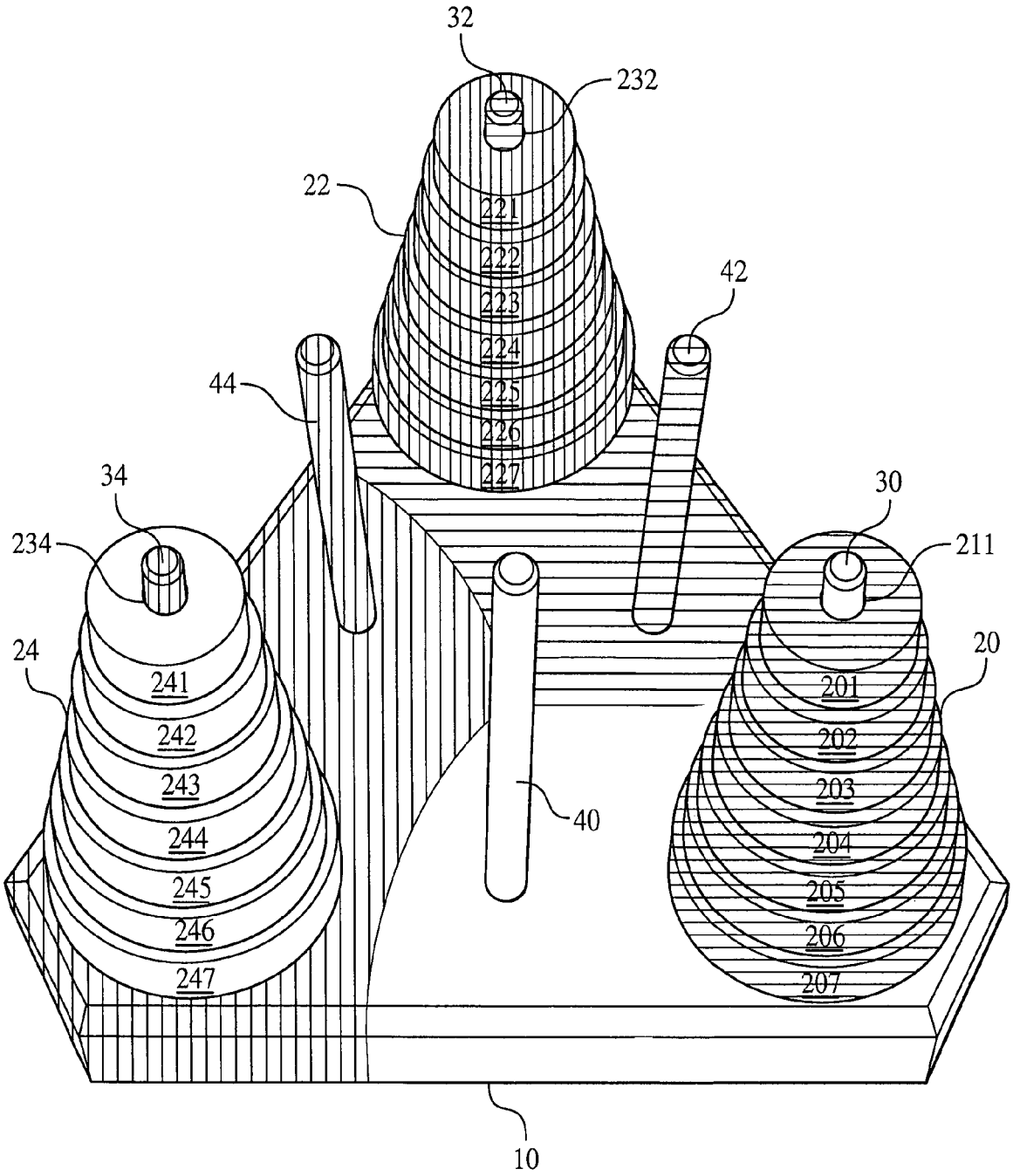
FIG. 5 shows a top perspective view of a stacking puzzle according to another embodiment of the invention.
Figure 6:
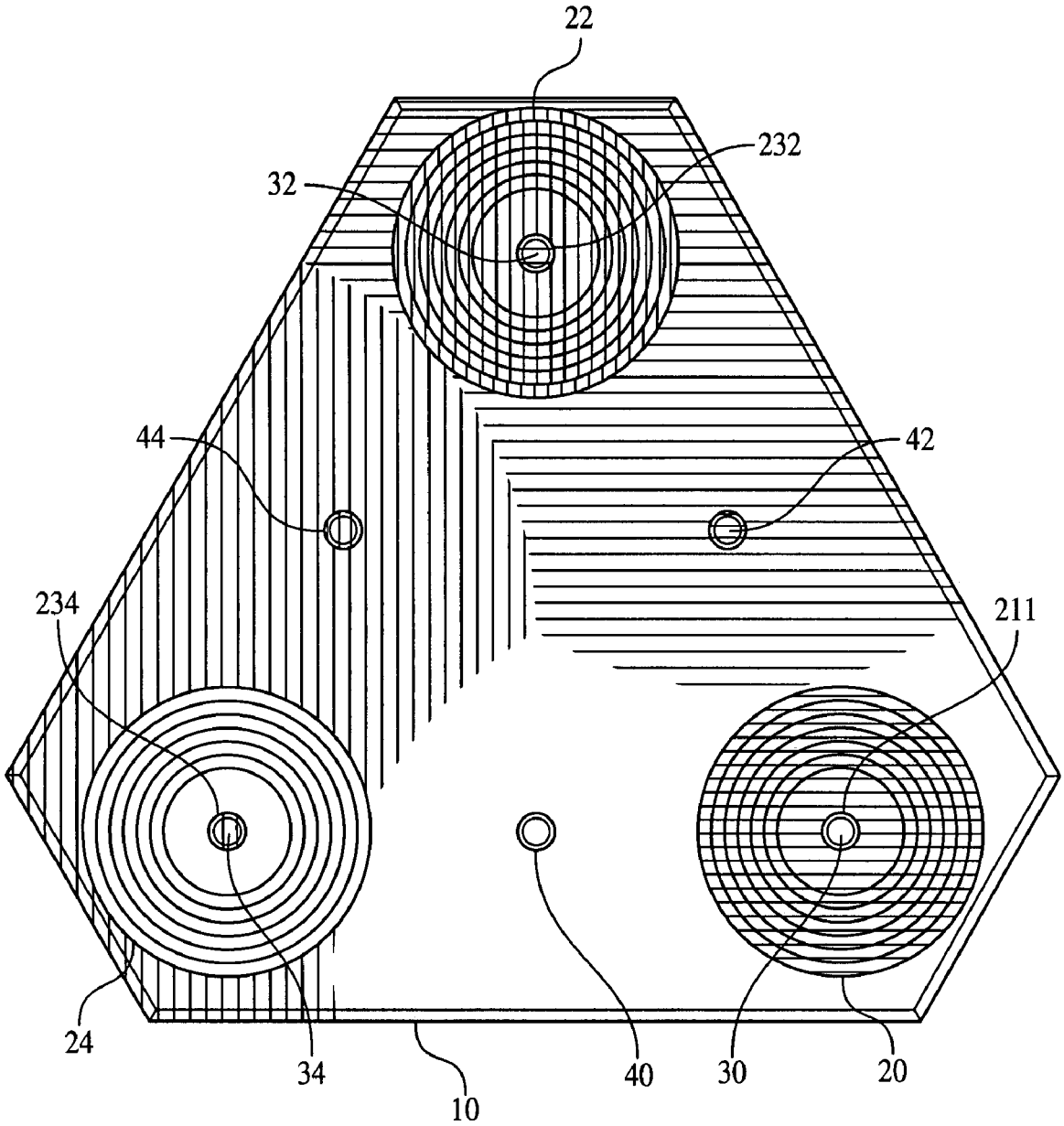
FIG. 6 shows a top view of the stacking puzzle shown in FIG. 5.

As shown, the puzzle includes a substantially horizontal stationary platform or base 10. Base 10 has a substantially flat upper and lower surface and may be constructed of any suitable rigid material, for example wood, plastic, metal, composites or the like. Base 10 may have a substantially square shape as shown in FIGS. 1-4, a truncated triangle shape as shown in FIGS. 5-6, or any other desired shape. Base 10 may include a color scheme corresponding to the colors of various playing pieces and/or pegs as well.

A plurality of collections or stacks 20, 22 of playing pieces are provided. As shown in FIGS. 1-2, the plurality of stacks may comprise two stacks 20, 22. Each stack 20, 22 comprises a plurality of playing pieces 201-207, 221-227. In one embodiment, each stack includes seven individual playing pieces. In another embodiment, each stack includes ten individual playing pieces. Each stack may include a greater or smaller quantity of playing pieces as well. Preferably each of the plurality of stacks includes an equal number of playing pieces as each of the remaining stacks.

Figure 7:
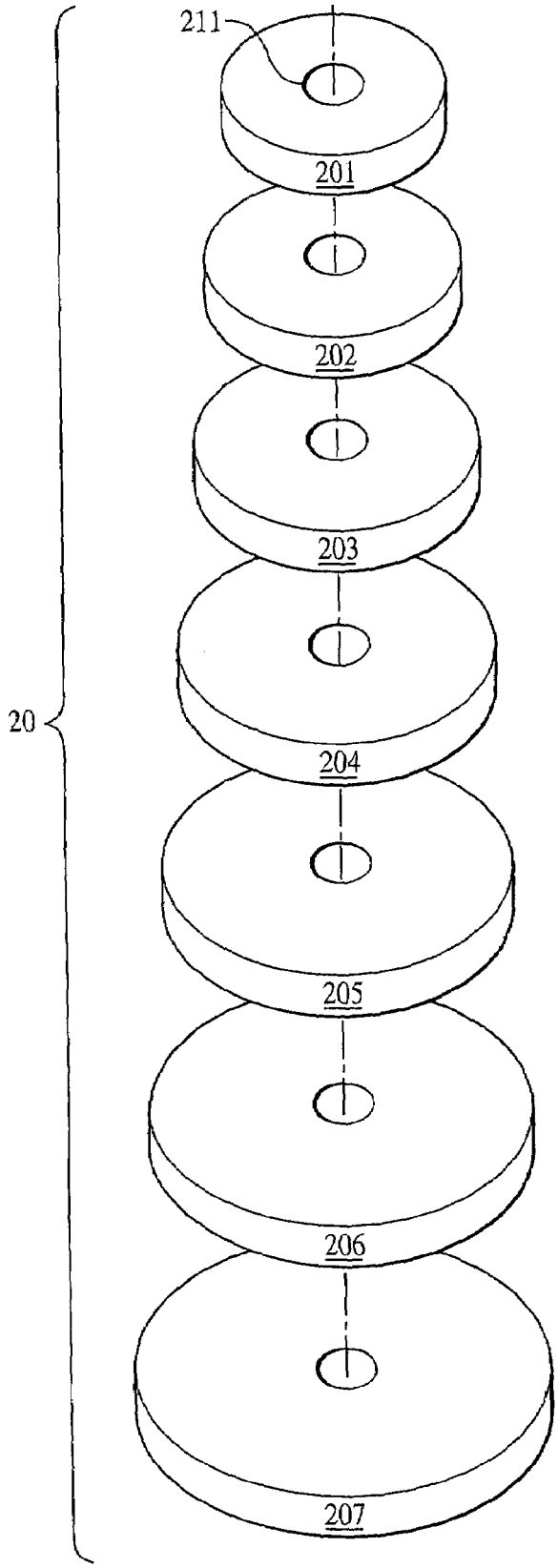
FIG. 7 shows a stack of playing pieces according to an embodiment of the invention.

The playing pieces may be of any suitable shape and dimension and preferably are in the form of circular disks as best shown in FIG. 7. Each playing piece belonging to a particular stack may have a different diameter. The playing pieces in a particular stack are initially arranged over a peg with a largest diameter playing piece 227 disposed at a bottom position, a smallest diameter playing piece 221 disposed at a top position and the remaining playing pieces arranged in ascending diameter order from the top position to the bottom position, as shown for example in FIG. 1. This arrangement of progressively larger playing pieces moving down the stack is also the required arrangement for the conclusion of the game, when the stack of disks is displaced to a peg other than the starting peg.

Each of the playing pieces includes a substantially centered hole or bore 211, 232 therethrough. Bore 211, 232 is dimensioned to accept one or more pegs 30, 32, so that the individual playing pieces can be slid over a peg for stacking.

A plurality of pegs 30, 32, 40, 42 extends upwardly from base 10. Twice as many pegs 30, 32, 40, 42 as stacks 20, 22 of playing pieces may be provided. For example, in the embodiments shown in FIGS. 1-4, two stacks of playing pieces 20, 22 and four individual pegs 30, 32, 40, 42 are provided. In the embodiment shown in FIGS. 5 and 6, three stacks of playing pieces 20, 22, 24 and six individual pegs 30, 32, 34, 40, 42, 44 are provided. As shown, the pegs are dimensioned such that the bores of individual playing pieces may be slid over a peg for stacking the playing pieces thereon.

The plurality of pegs include a plurality of shared pegs 32, 30 for receiving playing pieces from two of the plurality of stacks 20, 22. During play, playing pieces from two of the stacks of playing pieces may be placed over a peg which is designated as a shared peg. For example, any of the playing pieces 201-207 from stack 20 may be placed on shared pegs 30 or 32. FIGS. 1 and 2 show the stacks as they would be disposed at the commencement of a game. As shown, each of the stacks 20, 22 of playing pieces is initially disposed over a respective one of the shared pegs 30, 32 at the commencement of the game.

The plurality of pegs further includes a plurality of unshared pegs 40, 42 for receiving playing pieces from only one of the plurality of stacks associated with the particular unshared peg. During play, only playing pieces from a stack corresponding to the unshared peg may be placed over a peg designated as an unshared peg. For example, only playing pieces 201-207 from stack 20 may be placed on associated unshared peg 40. Playing pieces 221-227 from stack 22 may not be placed on unshared peg 40. Likewise, only playing pieces 221-227 from stack 22 may be placed on associated unshared peg 42. Playing pieces 201-207 from stack 20 may not be placed on unshared peg 42.

As shown, the plurality of playing pieces 221-227 belonging to a particular stack 22 may have a common visible indicium for distinguishing the plurality of playing pieces 221-227 in stack 22 from a plurality of playing piece 201-207 in another stack 20. This visible indicium may be a color, a symbol, a number, or any other indicium enabling a player to distinguish playing pieces associated with one stack from playing pieces associated with another stack. For example, the playing pieces 201-207 in a first stack 20 may be white, and the playing pieces 221-227 in a second stack 22 may be a contrasting color, such as black. In the three stack embodiment shown in FIGS. 5 and 6, playing pieces from the individual stacks 32, 30, 34 may be red, white and blue. As shown, the base 10 for each embodiment may have a color scheme corresponding to the playing pieces.

Additionally, the individual playing pieces in a stack may be provided with incrementally varying shades of gray or color. For example, the playing pieces in one stack may comprise the colors of the rainbow (red, orange, yellow, green, blue, indigo, violet) in order from largest diameter piece to smallest diameter piece and the playing pieces in another stack may comprise the same colors in the reverse order (from smallest diameter playing piece to largest diameter playing piece). Such color and/or shade arrangements may increase the degree of difficulty of the puzzle. Of course, the above colors schemes are exemplary only and any colors or other indicium permitting a player to distinguish playing pieces from one stack from playing pieces from another stack may be incorporated into a puzzle or a method for playing a puzzle according to embodiments of the invention.

Unshared pegs 40, 42 may have a visible indicium corresponding to a visible indicium of the plurality of playing pieces belonging to the stack associated with the unshared peg. For example, unshared peg 40 may be white in color to correspond to the playing pieces 201-207 from stack 20 associated with unshared peg 40. Likewise, unshared peg 42 may be black in color to correspond to the playing pieces 221-227 from stack 22 associated with unshared peg 42. Providing the unshared pegs with a visual indicator corresponding to the respective stack of playing pieces associated with that unshared peg assists a player in following the rules prohibiting the placement of playing pieces from a stack on an unshared peg not associated with that stack. Shared pegs 30, 32 may also have a visual indicator corresponding to an associated stack of playing pieces.

An object of the puzzle is to displace each of the plurality of stacks 20, 22 from an initial position on a respective shared peg 30, 32 to a final position on another of the pegs 32, 30, 42, 40 in a minimum number of moves. The puzzle is completed when each of the stacks has been displaced and the playing pieces from the respective stacks are arranged over a peg in the size order sequence as the stack was initially arranged, that is with a largest diameter playing piece 227 disposed at a bottom position, a smallest diameter playing piece 221 disposed at a top position and the remaining playing pieces arranged in ascending diameter order from the top position to the bottom position.

Preferably, at the conclusion of the puzzle, each stack of playing pieces is disposed on a peg (shared or unshared) wherein the visual indicium of the peg corresponds to the visual indicium of the respective stack. For example, in the embodiment shown in FIG. 1, at the conclusion of the game, black playing pieces 221-227 would be disposed on a black peg (30 or 42) and white playing pieces 201-207 would be disposed on a white peg (32 or 40).

The minimum number of moves required to complete the puzzle will depend on the number of pegs, stacks and playing pieces in each of the stacks. For example, the minimum number of moves required to complete a game according to an embodiment of the invention having three stacks of seven playing pieces each and six pegs would be five hundred and eight moves. The degree of difficulty of the game may therefore be selectively adjusted by using a larger or smaller number of playing pieces, stacks and/or pegs.

As in the traditional Towers of Hanoi puzzle, only one playing piece may be moved at a time. The playing pieces are moved by moving a topmost playing piece from a stack and placing it on either a shared peg or on an unshared peg associated with that stack of playing pieces. The playing piece may be placed over another playing piece only if the lower playing piece is larger in size, that is a first playing piece cannot be placed over a second playing piece having a same or smaller diameter. Moreover, as described above, a playing piece from a stack not associated with a particular unshared peg cannot be placed on that particular unshared peg.

Figure 3:
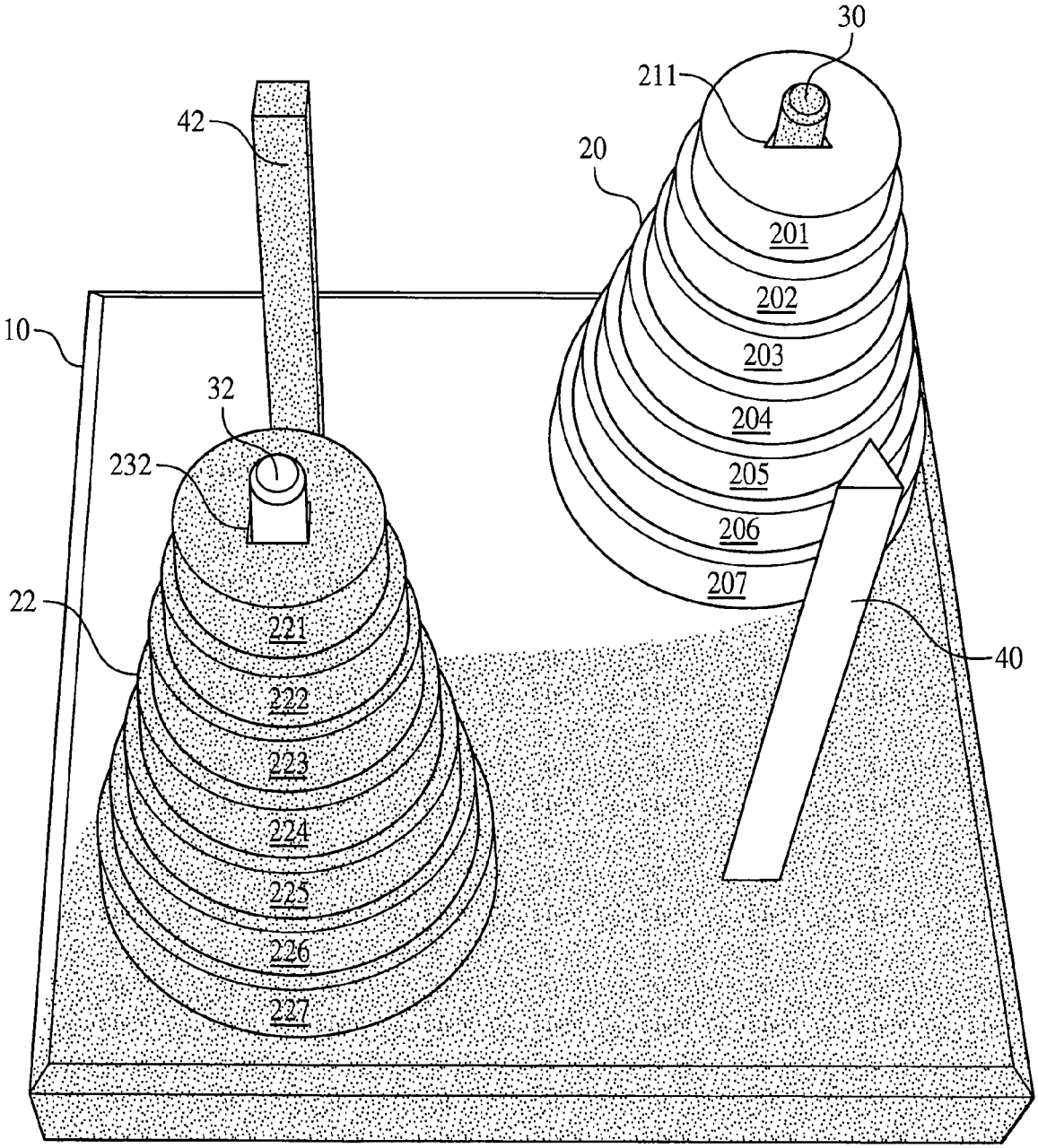
FIG. 3 shows a top perspective view of a stacking puzzle according to another embodiment of the invention.
Figure 4:
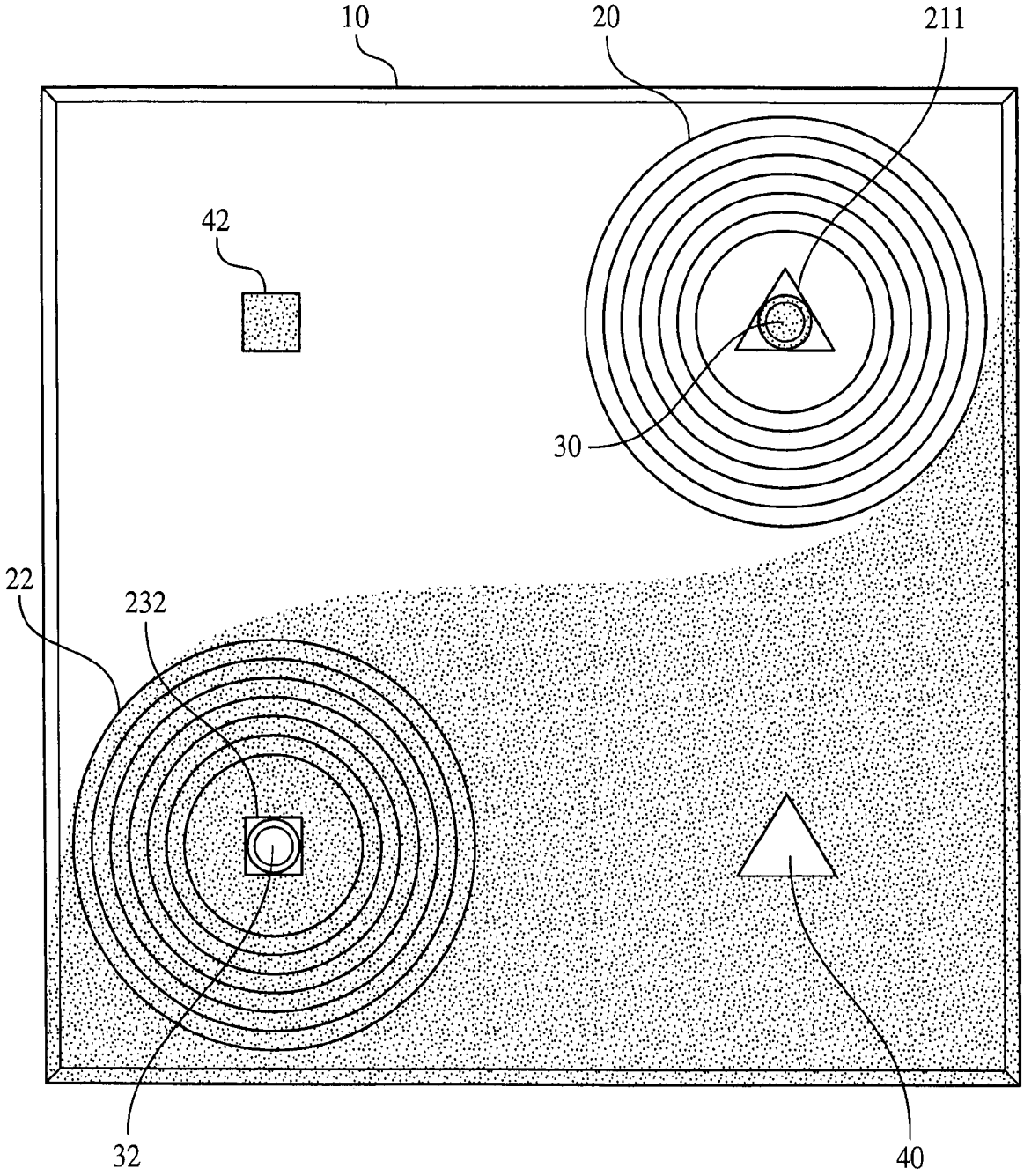
FIG. 4 shows a top view of the stacking puzzle shown in FIG. 3.

FIGS. 3 and 4 show an embodiment wherein each of shared pegs 30, 32 is dimensioned to receive playing pieces from each of the stacks 20, 22 and each of the unshared pegs 40, 42 is dimensioned to receive playing pieces from only the stack associated with the unshared peg. In particular, shared peg 30 is dimensioned so as to accommodate playing pieces form each of stacks 20 and 22 and shared peg 32 is likewise dimensioned to accommodate playing pieces from each of stacks 20 and 22. Unshared peg 40, however can only receive playing pieces from associated stack 20 and not from stack 22. Unshared peg 42 can only receive playing pieces from associated stack 22 and not from stack 20. In this way, the prohibition on placing playing pieces from a stack not associated with a particular unshared peg on that unshared peg is implemented by virtue of the physical structure of the pegs and playing pieces.

As shown in the embodiment of FIGS. 3 and 4, the bore 211 in the playing pieces 201-207 belonging to stack 20 may be triangular in shape and an unshared peg 40 associated with stack 20 may have a corresponding triangular cross section. The bore 232 in the playing pieces 221-227 belonging to stack 22 may be square in shape and an unshared peg 42 associated with stack 22 may have a corresponding square cross section. Shared pegs 30, 32 may have a circular cross section dimensioned such that playing pieces from both stacks 20 and 22 may be placed over the shared pegs.

As a result of the shapes and dimensions of the respective playing piece bores and of the shared and unshared pegs, playing pieces from either stack 20 or 22 may be placed over either of shared pegs 30 and 32, however only playing pieces from stack 20 may be placed over unshared peg 40 and only playing pieces from stack 22 may be placed over unshared peg 42. The triangular bore 211 of the playing pieces 201-207 in stack 20 will not fit over unshared peg 42 having a square cross section. Likewise, the square bore 232 of the playing pieces 221-227 in stack 22 will not fit over unshared peg 40 having a triangular cross section. The shapes and relative dimensions of the playing piece bores and pegs as shown and described herein are exemplary only, and it is recognized that the implementation of the puzzle rule prohibiting the placement of playing pieces from a stack not associated with a particular unshared peg on that unshared peg may be achieved with numerous shapes and sizes of playing piece bores and pegs, all of which are considered to be within the scope of the invention.

FIGS. 5 and 6 show another embodiment of the invention wherein three stacks of playing pieces and six pegs are provided. The puzzle shown in FIGS. 5 and 6 is similar in arrangement and operation to the puzzle described above, except that a third stack 24 of playing pieces 241-247, a third shared peg 34 and a third unshared peg 44 have been added. As shown, the stacks 20, 22, 24 may be initially arranged at each of the three corners of a triangular base 10. The stacks 20, 22, 24 as shown in FIGS. 5 and 6 are disposed on respective shared pegs 30, 32, 34 in the positions the stacks occupy at the beginning of the game.

To complete the puzzle as shown in FIGS. 5 and 6, the playing pieces 201-207 from stack 20 (which may be, for example red in color) are displaced onto shared peg 32 or unshared peg 42 (which may also be red in color), the playing pieces 241-247 from stack 24 (which may be, for example white in color) are displaced onto shared peg 30 or unshared peg 40 (which may also be white in color) and the playing pieces 221-227 from stack 22 (which may be, for example blue in color) are displaced onto shared peg 34 or unshared peg 44 (which may also be blue in color).

Only playing pieces from a stack associated with the unshared peg may be placed over that unshared peg. For example, only playing pieces 241-247 from stack 24 may be placed over unshared peg 40. Unshared pegs 40, 42 and 44 may have a color or other visible indicium corresponding to a color or other visible indicium of the stack of playing pieces associated with the respective unshared peg.

Shared pegs 30, 32 and 34 may be for receiving playing pieces from only two of the three stacks of playing pieces. For example, only playing pieces 241-247 from stack 24 and playing pieces 221-227 from stack 22 may be disposed on shared peg 34 and playing pieces 201-207 from stack 20 may not be disposed on shared peg 34.

Figure 8:
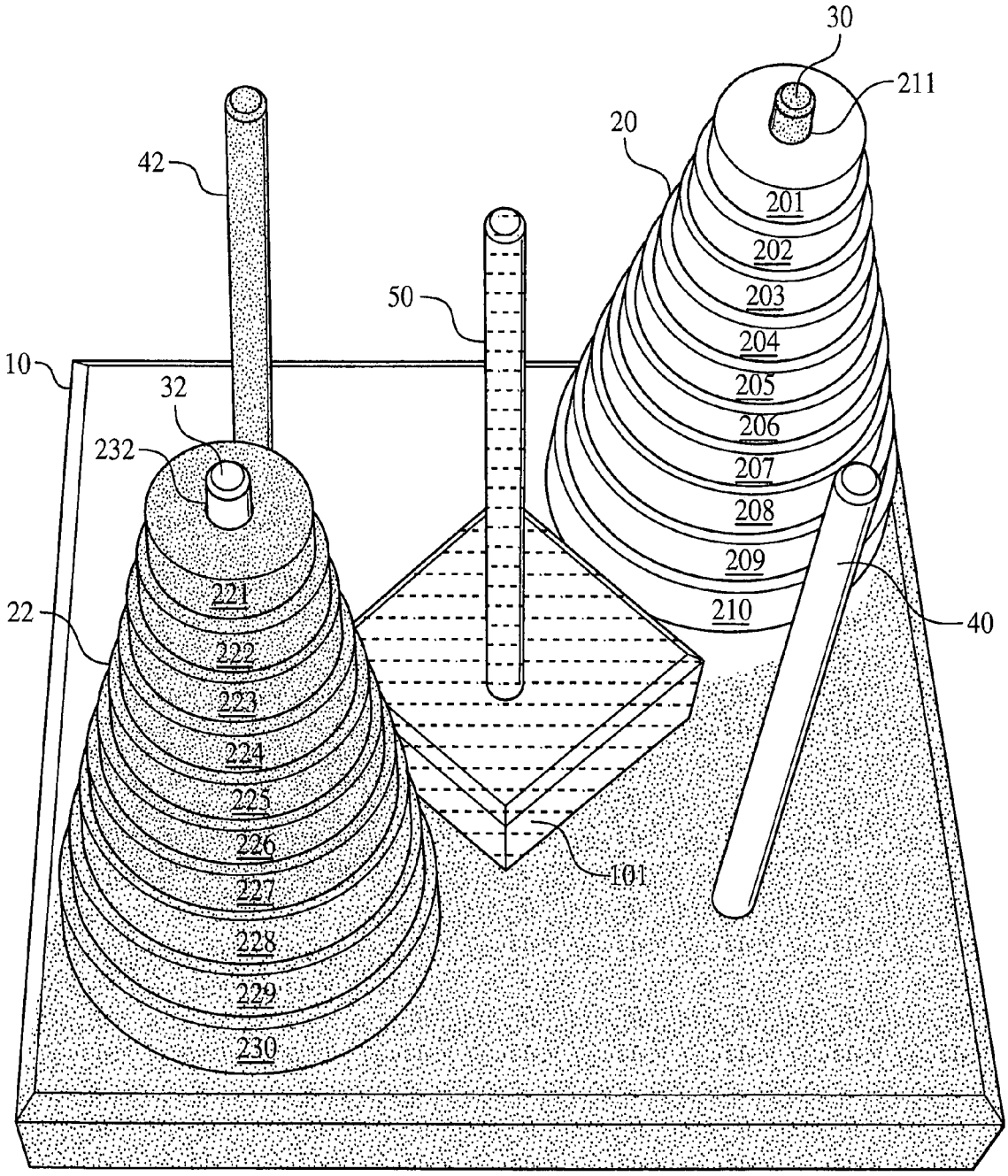
FIG. 8 shows a top perspective view of a stacking puzzle according to another embodiment of the invention.
Figure 9:
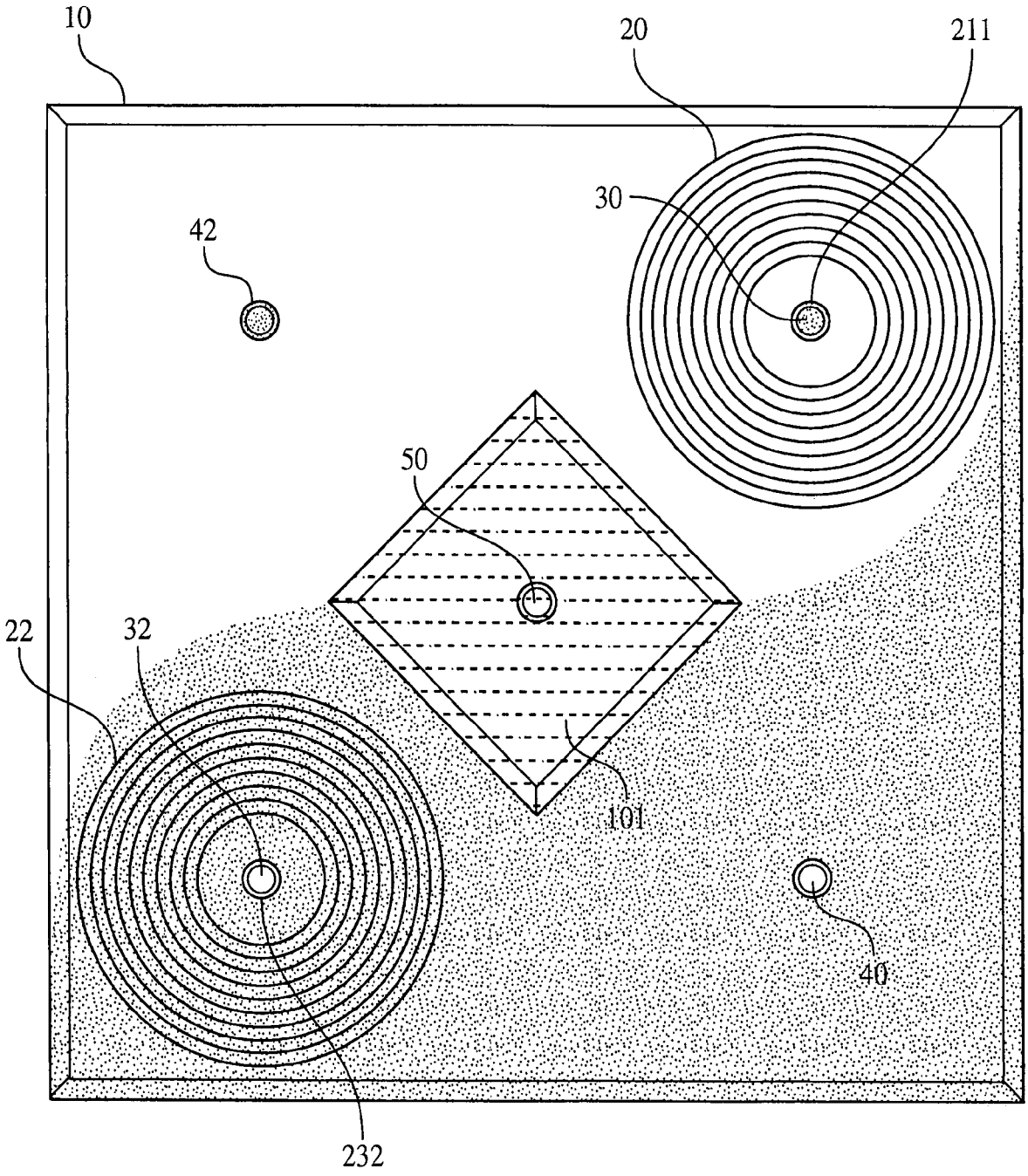
FIG. 9 shows a top view of the stacking puzzle shown in FIG. 8.

FIGS. 8 and 9 show another embodiment of the invention wherein two stacks of playing pieces and five pegs are provided. The puzzle shown in FIGS. 8 and 9 is similar in arrangement and operation to the puzzle described above, except that a fifth peg is provided and each stack of playing pieces includes ten playing pieces. The respective stacks 20, 22 of playing pieces 201-210 and 221-230 as shown in FIGS. 8 and 9 are positioned on shared pegs 30, 32 in the positions occupied at the beginning of the game.

The fifth or additional peg may comprise a centrally located universal or unrestricted peg 50 for receiving playing pieces from any of the stacks 20, 22. In further embodiments, the puzzle may include a plurality of such universal or unrestricted shared pegs. In a puzzle according to an embodiment of the invention wherein three or more stacks of playing pieces are provided, universal shared peg 50 differs from the remaining shared pegs in that the universal shared peg can receive playing pieces from any of the stacks, while the other shared pegs can only receive playing pieces from two of the stacks.

Universal or unrestricted shared peg 50 may extend upwardly from a central portion of base 10 and is spaced apart a sufficient distance from the remaining pegs to allow playing pieces from each of the stacks to be disposed on universal shared peg 50. Universal shared peg 50 may further be disposed over a pedestal base 101 formed from the same material as stationary base 10. The height of universal shared peg 50 may be slightly greater than the remaining shared and unshared pegs. For example, universal shared peg 50 may be taller than pegs 30, 32, 40 and 42 by a distance approximately equal to a thickness of one of the playing pieces.

The universal shared peg preferably includes a visible indicium corresponding to visible indicium provided on the playing pieces of each of the stacks to indicate that the universal shared peg 50 can accommodate playing pieces from any of the stacks. For example, playing pieces 201-210 from stack 20 may be white in color, playing pieces 221-230 from stack 22 may be black in color, and universal shared peg 50 may be gray or some combination of black and white in color.

A method for playing a stacking puzzle according to an embodiment of the invention includes the steps of providing a plurality of stacks of playing each stack including a plurality of playing pieces wherein each playing piece belonging to a particular stack has a different diameter.

A plurality of pegs are also provided. The number of pegs is equal to twice the number of stacks. The pegs include a plurality of shared pegs for receiving playing pieces from two of the stacks and a plurality of unshared pegs for receiving playing pieces from only one stack of the plurality of stacks associated with a particular unshared peg.

Each stack is arranged on a respective one of the plurality of shared pegs with a largest diameter playing piece disposed at a bottom position, a smallest diameter playing piece disposed at a top position and remaining playing pieces arranged in ascending diameter order from top to bottom.

Each of the plurality of stacks is displaced from an initial position on the respective one of the plurality of shared pegs to a final position on another of the pegs by moving each of the plurality of playing pieces one at a time from its initial position on a shared pegs to another of the pegs. A playing piece cannot be placed over another playing piece having a same or smaller diameter. A playing piece from a stack not associated with a particular unshared peg cannot be placed on that particular unshared peg.

An object of the puzzle is to displace each of said plurality of stacks in a minimum number of moves.

A method for playing a stacking puzzle according to another embodiment of the invention included the steps of providing a plurality of stacks of playing pieces, each stack including a plurality of playing pieces, wherein each playing piece belonging to a particular stack has a different diameter.

A plurality of pegs are also provided. The pegs include a plurality of unshared pegs for receiving playing pieces from only one stack of said plurality of stacks associated with a particular unshared peg and a plurality of shared pegs. The shared pegs include a plurality of first shared pegs for receiving playing pieces from two stacks of the plurality of stacks and a centrally located universal shared peg for receiving playing pieces from each of the plurality of stacks.

Each stack is initially arranged on a respective one of the first shared pegs with a largest diameter playing piece disposed at a bottom position, a smallest diameter playing piece disposed at a top position and remaining playing pieces arranged in ascending diameter order from top bottom.

Each of the plurality of stacks is disposed from an initial position on the respective first shared peg to a final position on another of the pegs by moving each of the playing pieces one at a time from the first shared pegs to another peg. A playing piece cannot be placed over another playing piece having a same or smaller diameter. A playing piece from a stack not associated with a particular unshared peg cannot be placed on that particular unshared peg.

An object of the puzzle is to displace each of the plurality of stacks in a minimum number of moves.

A method according to an embodiment of the invention may be carried out in three dimensions using a physical apparatus, according to the arrangements described above. Alternatively, a method according to an embodiment of the invention may be carried out as a simulation in a two dimensional format wherein a representation of the board, pegs, stacks and playing pieces is projected onto a video monitor, screen or the like. A player would initiate the simulated movement of playing pieces with a user input coupled to the display, for example using a joystick, computer mouse device or a touch screen. The two dimensional puzzle simulation could implement the puzzle rules with appropriate programming and a counter may be provided to count, display and/or record a number of moves.

Accordingly, while several embodiments of the present invention have been shown and described, it is obvious that many changes and modifications may be made thereunto without departing from the spirit and scope of the invention.

What is claimed is:

1. A stacking puzzle comprising:

a) a substantially horizontal stationary base;

b) a plurality of stacks of playing pieces, each stack of said plurality of stacks comprising a plurality of playing pieces, each playing piece of said plurality of playing pieces belonging to a particular stack having a different diameter and a substantially centered bore therethrough, wherein the playing pieces in each stack of said plurality of stacks are initially arranged with a largest diameter playing piece disposed at a bottom position, a smallest diameter playing piece disposed at a top position and remaining playing pieces arranged in ascending diameter order from said top position to said bottom position;

c) a plurality of pegs extending upwardly from said base, wherein a number of said plurality of pegs is equal to twice a number of said plurality of stacks, said plurality of pegs comprising:

i) a plurality of shared pegs for receiving playing pieces from two of said plurality of stacks, wherein a number of said plurality of shared pegs is equal to said number of said plurality of stacks and wherein each stack of said plurality of stacks is initially disposed over a respective one of said plurality of shared pegs; and ii) a plurality of unshared pegs, each of said plurality of unshared pegs for receiving playing pieces from only one of said plurality of stacks associated with a particular unshared peg, wherein a number of said plurality of unshared pegs is equal to said number of said plurality of shared pegs and equal to said number of said plurality of stacks;

wherein an object of the puzzle is to displace each of said plurality of stacks from an initial position on said respective one of said plurality of shared pegs to a final position on another of said plurality of pegs in a minimum number of moves by moving each of said plurality of playing pieces from said respective one of said plurality of shared pegs to another of said plurality of pegs one at a time, wherein a first playing piece cannot be placed over a second playing piece having a same or smaller diameter and wherein a playing piece from a stack not associated with a particular unshared peg cannot be placed on said particular unshared peg.

2. The stacking puzzle according to claim 1, wherein said plurality of playing pieces belonging to a particular stack have a common visible indicium for distinguishing said plurality of playing pieces from said particular stack from a plurality of playing pieces from another stack of said plurality of stacks.

3. The stacking puzzle according to claim 2, wherein each of said plurality of unshared pegs has a visible indicium corresponding to a visible indicium of said plurality of playing pieces belonging to said particular stack associated with said unshared peg.

4. The stacking puzzle according to claim 2, wherein the puzzle is completed when each of said plurality of stacks is disposed on a respective peg of said plurality of pegs, said respective peg having a visible indicium corresponding to said common visible indicium of said plurality of playing pieces belonging to said stack disposed thereon.

5. The stacking puzzle according to claim 4, wherein said visible indicium comprises a color.

6. The stacking puzzle according to claim 1, wherein said each of said plurality of shared pegs is dimensioned to receive playing pieces from each of said plurality of stacks and wherein each of said plurality of unshared pegs is dimensioned to receive playing pieces from only one of said plurality of stacks associated with said particular unshared peg.

7. The stacking puzzle according to claim 1, wherein said plurality of stacks comprises two stacks and said plurality of pegs comprises four pegs.

8. The stacking puzzle according to claim 1, wherein said plurality of stacks comprises three stacks and said plurality of pegs comprises six pegs.

9. A method for playing a stacking puzzle, the method comprising the steps of:

a) providing a plurality of stacks of playing pieces, each stack of said plurality of stacks comprising a plurality of playing pieces, each playing piece of said plurality of playing pieces belonging to a particular stack having a different diameter;

b) providing a plurality of pegs, wherein a number of said plurality of pegs is equal to twice a number of said plurality of stacks, said plurality of pegs comprising a plurality of shared pegs for receiving playing pieces from two stacks of said plurality of stacks and a plurality of unshared pegs for receiving playing pieces from only one stack of said plurality of stacks associated with a particular unshared peg, wherein a number of said plurality of shared pegs equals a number of said plurality of unshared pegs and equals said number of said plurality of stacks;

c) arranging each stack of said plurality of stacks on a respective one of said plurality of shared pegs with a largest diameter playing piece disposed at a bottom position, a smallest diameter playing piece disposed at a top position and remaining playing pieces arranged in ascending diameter order from said top position to said bottom position;

d) displacing each of said plurality of stacks from an initial position on said respective one of said plurality of shared pegs to a final position on another of said plurality of pegs by moving each of said plurality of playing pieces one at a time from said respective one of said plurality of shared pegs to another of said plurality of pegs, wherein a first playing piece cannot be placed over a second playing piece having a same or smaller diameter, wherein a playing piece from a stack not associated with a particular unshared peg cannot be placed on said particular unshared peg, and wherein an object of the puzzle is to displace each of said plurality of stacks in a minimum number of moves.

10. A stacking puzzle comprising:

a) a substantially horizontal stationary base;

b) a plurality of stacks of playing pieces, each stack of said plurality of stacks comprising a plurality of playing pieces, each playing piece of said plurality of playing pieces belonging to a particular stack having a different diameter and a substantially centered bore therethrough, wherein the playing pieces in each stack of said plurality of stacks are initially arranged with a largest diameter playing piece disposed at a bottom position, a smallest diameter playing piece disposed at a top position and remaining playing pieces arranged in ascending diameter order from said top position to said bottom position;

c) a plurality of pegs extending upwardly from said base, said plurality of pegs comprising:

i) a plurality of shared pegs, said plurality of shared pegs comprising:

A) a plurality of first shared pegs for receiving playing pieces from two of said plurality of stacks, wherein a number of said plurality of first shared pegs is equal to a number of said plurality of stacks and wherein each stack of said plurality of stacks is initially disposed over a respective one of said first plurality of shared pegs; and B) a centrally located universal shared peg for receiving playing pieces from each of said plurality of stacks, wherein no playing pieces from said plurality of playing pieces are disposed on said universal shared peg at either a beginning or a conclusion of the puzzle; and ii) a plurality of unshared pegs, each of said plurality of unshared pegs for receiving playing pieces from only one of said plurality of stacks associated with a particular unshared peg,;

wherein an object of the puzzle is to displace each of said plurality of stacks from an initial position on said respective one of said plurality of first shared pegs to a final position on another of said plurality of pegs in a minimum number of moves by moving each of said plurality of playing pieces from said respective one of said plurality of first shared pegs to another of said plurality of pegs one at a time, wherein a first playing piece cannot be placed over a second playing piece having a same or smaller diameter and wherein a playing piece from a stack not associated with a particular unshared peg cannot be placed on said particular unshared peg.

11. The stacking puzzle according to claim 10, wherein said plurality of playing pieces belonging to a particular stack have a common visible indicium for distinguishing said plurality of playing pieces from said particular stack from a plurality of playing pieces from another stack of said plurality of stacks.

12. The stacking puzzle according to claim 11, wherein each of said plurality of unshared pegs has a visible indicium corresponding to a visible indicium of said plurality of playing pieces belonging to said particular stack associated with said unshared peg.

13. The stacking puzzle according to claim 11, wherein the puzzle is completed when each of said plurality of stacks is disposed on a respective peg of said plurality of pegs, said respective peg having a visible indicium corresponding to said common visible indicium of said plurality of playing pieces belonging to said stack disposed thereon.

14. The stacking puzzle according to claim 13, wherein said visible indicium comprises a color.

15. The stacking puzzle according to claim 14, wherein said universal shared peg has a visible indicium corresponding to each of said visible indicium provided on each of said plurality of stacks of playing pieces.

16. The stacking puzzle according to claim 10, further comprising a pedestal base disposed substantially centrally on said stationary base, wherein said universal shared peg extends upwardly from said pedestal base.

17. A method for playing a stacking puzzle, the method comprising the steps of:

a) providing a plurality of stacks of playing pieces, each stack of said plurality of stacks comprising a plurality of playing pieces, each playing piece of said plurality of playing pieces belonging to a particular stack having a different diameter;

b) providing a plurality of pegs, said plurality of pegs comprising a plurality of unshared pegs for receiving playing pieces from only one stack of said plurality of stacks associated with a particular unshared peg and a plurality of shared pegs, said plurality of shared pegs comprising a plurality of first shared pegs for receiving playing pieces from two stacks of said plurality of stacks and a centrally located universal shared peg for receiving playing pieces from each of said plurality of stacks;

c) arranging each stack of said plurality of stacks on a respective one of said plurality of first shared pegs with a largest diameter playing piece disposed at a bottom position, a smallest diameter playing piece disposed at a top position and remaining playing pieces arranged in ascending diameter order from said top position to said bottom position;

d) displacing each of said plurality of stacks from an initial position on said respective one of said plurality of first shared pegs to a final position on another of said plurality of pegs by moving each of said plurality of playing pieces one at a time from said respective one of said plurality of first shared pegs to another of said plurality of pegs, wherein a first playing piece cannot be placed over a second playing piece having a same or smaller diameter, wherein a playing piece from a stack not associated with a particular unshared peg cannot be placed on said particular unshared peg, and wherein an object of the puzzle is to displace each of said plurality of stacks in a minimum number of moves.

* * * * *